United States Patent [19]

Stanley

[11] Patent Number: 4,702,027

[45] Date of Patent: Oct. 27, 1987

[54] THERMAL LINER FOR GUN FIRING CHAMBER

[76] Inventor: Edward T. Stanley, 8210 10 Mile Rd., Apt. B-18, Centerline, Mich. 480915

[21] Appl. No.: 900,129

[22] Filed: Aug. 18, 1986

[51] Int. Cl.[4] ..... F41C 21/12; F41F 17/08

[52] U.S. Cl. ..... 42/76.02; 42/77; 89/16

[58] Field of Search ..... 42/76.02, 77; 89/16

[56] References Cited

U.S. PATENT DOCUMENTS

| | | | |
|---|---|---|---|
| 2,426,972 | 9/1947 | Magos | 89/16 X |
| 3,339,598 | 9/1968 | Hornfeck et al. | 89/24 |
| 3,602,283 | 11/1969 | Schlack | 149/28 |
| 3,645,207 | 2/1972 | Daniels | 102/40 |
| 3,768,191 | 10/1973 | Vasallo | 42/76.02 |
| 3,866,513 | 2/1975 | Hornfeck et al. | 89/24 |
| 3,901,153 | 8/1975 | Brabets | 102/38 |
| 4,213,392 | 7/1980 | Usel | 102/46 |

OTHER PUBLICATIONS

Ownby et al., "Feasibility Study of Fabricating Composite Ceramic Chamber Liners for Small Caliber Automatic Weapons, May 1985, p. 36.

*Primary Examiner*—Deborah L. Kyle
*Assistant Examiner*—Ted L. Parr
*Attorney, Agent, or Firm*—Peter A. Taucher; John E. McRae

[57] ABSTRACT

A liner for the firing chamber of a gun, designed to prevent ammunition "cook-off". The liner minimizes flow of heat into the chamber wall, incident to the combustion process. The liner also retards the flow of heat in the reverse direction, i.e. from the chamber wall into a chambered round. Liner design is such that the liner can be removed and replaced by a new liner when it is damaged.

2 Claims, 4 Drawing Figures

THERMAL LINER FOR GUN FIRING CHAMBER

GOVERNMENT INTEREST

The invention described herein may be manufactured, used, and licensed by or for the Government for governmental purposes without payment to me of any royalty.

BACKGROUND AND SUMMARY OF THE INVENTION

Some military guns are designed to fire ammunition of the "completely combustible" type. The term "completely combustible" is here used to mean an ammunition cartridge that is essentially all-propellant in character (i.e., caseless), or an ammunition cartridge wherein the propellant is housed within a combustible case.

U.S. Pat. No. 3,602,283 to Schlack and U.S. Pat. No. 4,213,392 to Usel show ammunition of the caseless cartridge type. U.S. Pat. No. 3,645,207 to Daniels and U.S. Pat. No. 3,901,153 to Brabets et al. show ammunition of the combustible case type.

In some instances, combustible cartridge ammunition experiences a "cook-off" problem. The term "cook-off" is here used to mean premature propellant ignition when the projectile-cartridge assembly is introduced into the gun. The problem is somewhat more troublesome with combustible ammunition because there is no brass cartridge case to absorb heat that otherwise radiates from the firing chamber wall into the cartridge propellant.

The present invention seeks to prevent cook-off problems associated with the firing of combustible cartridge ammunition.

THE DRAWINGS

Figure 1:
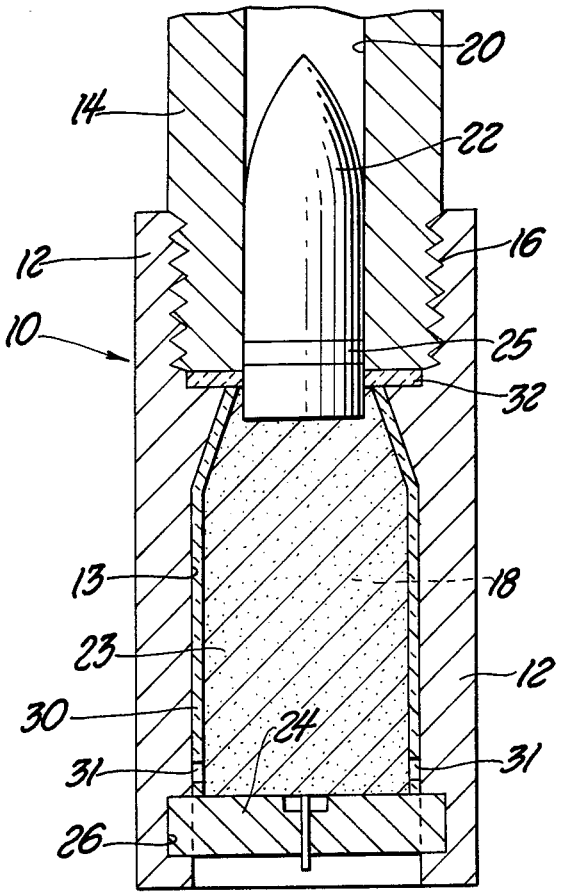
FIG. 1 illustrates in section a gun structure embodying my invention. A projectile-cartridge assembly is shown in firing position within the gun.

Referring in greater detail to the drawings, there is shown a gun 10 comprised of an annular barrel section 12 and tube section 14, screwed together as at 16. Sections 12 and 14 are formed of steel or similar high strength material.

Barrel section 12 has an interior surface 13 that defines a relatively large diameter firing chamber 18. Tube section 14 includes an annular interior guide surface 20 designed to guide projectile 22 during its travel out of the gun. A conventional breech block 24 is movably arranged to close the aft (lower) end of barrel section 12 when a cartridge is loaded into the firing chamber.

The breech block may be of conventional design, as shown for example in U.S. Pat. No. 3,399,598 to Hornfeck et al. or U.S. Pat. No. 3,866,513 to Hornfeck et al. The breech block is designed to slide in a transverse direction within a groove 26 formed in the aft end of barrel section 12.

Figure 3:
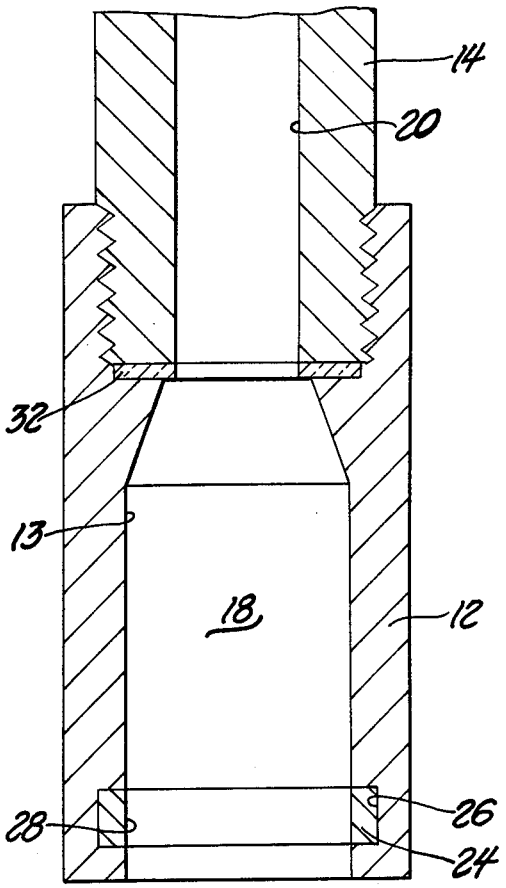
FIG. 3 is a view taken in the same direction as FIG. 1, with the projectile-cartridge assembly removed to better show the gun structure. A thermal liner used in practice of my invention is also removed.
Figure 2:
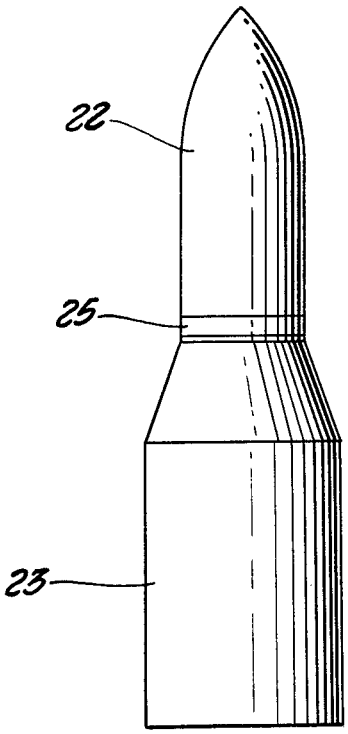
Fig. 2 PRIOR ART
FIG. 2 illustrates the projectile-cartridge assembly prior to insertion thereof into the gun.
Figure 4:
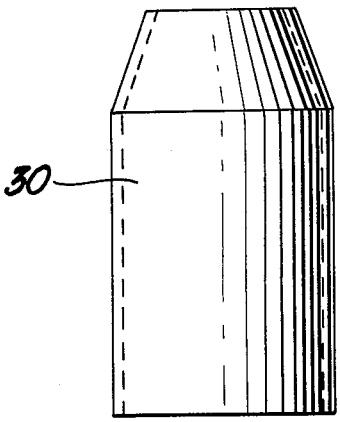
FIG. 4 illustrates a thermal liner used in practice of the invention.

The breech block has two positions. In the FIG. 1 position, the block closes the firing chamber. In the FIG 3 position, the breech block is located so that a circular hole 28 therein registers with the firing chamber; when block 24 is in the FIG. 3 position, a new projectile-cartridge assembly can be loaded into the firing chamber through hole 28.

The ammunition is of conventional known configuration, comprising a projectile 22 and attached combustible cartridge 23. The projectile may be of the armor-piercing type or the high explosive incendiary type. The projectile may have an obturator band 25 thereon designed to interfit with helical rifling (land-groove means) on guide surface 20, whereby the projectile is given a spinning motion during passage out of the gun. Alternately, the gun may be of the smooth-bore type, in which case the projectile will travel through the gun without spin.

My invention is particularly concerned with a thermal liner 30 for firing chamber 18. Liner 30 is shaped to the interior configuration of the firing chamber so that the outer annular surface of the liner is snugly received in the firing chamber. Preferably, the liner is removably engaged with the firing chamber wall, such that it can be removed when worn or damaged: the liner is shown with holes 31 therein adapted to be engaged by a pulling implement when it is desired to remove the liner from chamber 18. The liner extends the full axial length of the firing chamber, from the aft end of tube section 14 to the inner face of breech block 24.

An auxiliary thermal disk 32 may be interposed between the lower end of tube section 14 and an interior surface of barrel section 12; disk 32 minimizes heat transfer from barrel section 12 to tube section 14. Disk 32 may be formed of the same material as liner 30.

Liner 30 is formed of a material having thermal insulating properties. The material must not degrade, burn or disintegrate at high temperatures in the vicinity of 600° F.–900° F. Ceramics, such as silicon carbide or silicon nitride, are believed to be suitable. Glass fiber cloth impregnated with a refractory cement or a thermosetting resin, such as melamine or cross linked silicone, may prove to be suitable. Graphite fibers could probably be used in place of the fiberglass cloth.

The material for liner 30 should be reasonably resistant to high temperatures generated in firing chamber 18. However, the liner is a replaceable throw-away item; therefore, the liner can have a shorter life than barrel section 12 or tube section 14 while still realizing the aims of the invention.

The principal purpose of liner 30 is to retard the flow of heat from the combusted cartridge 23 to metal surface 18. Heat generated by the combustion process is at least partially exhausted out of the firing chamber rather than penetrating through metal surface 13 into barrel section 12.

In conventional gun constructions, the metal surface 13 of the firing chamber is in direct physical contact with the propellant cartridge. Barrel section 12 gets quite hot after repeated firings. The metal wall acts as a heat sink so that metal surface 13 can prematurely ignite a propellant cartridge 23 as the cartridge-projectile assembly is rammed into the gun chamber. It is believed that thermal liner 30 will have a lower temperature than the conventional metal firing chamber surface; the lower temperature on the inner surface of liner 30 should be a deterrent to premature ignition of the propellant cartridge.

The primary intent of liner 30 is to act as a barrier to heat flow from the burning cartridge 23 toward metal surface 13, thereby causing the generated heat to largely remain in the gas zone. As the gas is displaced out of chamber 18 by the next cartridge the generated heat will be carried away with the displaced gas (air and combustion products). Hopefully, barrel section 12 will receive a lesser percentage of the heat such that shielded metal surface 13 will remain at a relatively low temperature (but still hot of course).

Liner 30 is heated from two directions, i.e., on its inner surface by the burning propellant, and on its outer surface by the heated barrel section 12 wall. By retarding the initial flow of heat to barrel section 12, it is hoped that one of the two heating actions will be reduced or curtailed, thereby lowering the operating temperature of the liner.

Disk 32 is an optional item designed to minimize heat flow from barrel section 12 to tube section 14. The aim is to somewhat reduce the temperature of tube surface 20 and thereby minimize heat flow from surface 20 into projectile 22. In this way the projectile end face is prevented from prematurely detonating the propellant cartridge. Of course, if liner 30 proves to be especially effective as a mechanism for reducing the temperature of barrel section 12 then insulator disk 32 may not be necessary.

Liner 30 is preferably a one piece imperforate annular member extending the full axial length of the firing chamber. However, it is believed that the liner could be perforated as long as sufficient liner wall area was present to establish a thermal barrier; perforations in the liner wall might prove useful in allowing a cooling (scrubbing) action of the gases on the liner surfaces. A one piece liner design is believed the most practical from the standpoint of manufacturing cost and ease of installation in the firing chamber; however, multi-piece liner designs are believed possible.

A multi-piece liner design may prove easier to remove from the gun chamber when worn or spent. Whether the liner is a one-piece unit or a multi-piece unit, it should be designed and sized for removable disposition in the gun chamber. A slip fit of the liner in the gun chamber is contemplated. Such a fit promotes easy removability while at the same time providing an interface that retards flow of heat from the metal wall into the liner material.

I wish it to be understood that I do not desire to be limited to the exact details of construction shown and described for obvious modifications will occur to a person skilled in the art, without departing from the spirit and scope of the appended claims.

I claim:

1. In a gun designed to fire a round of ammunition comprised of a projectile and attached combustible cartridge, said cartridge being completely combustible; said gun comprising an annular barrel section defining a firing chamber designed to receive the cartridge, a tube section defining a guide surface for the projectile as it travels out of the gun, and a transversely movable breech block designed to removably close the aft end of the firing chamber when a cartridge is disposed therein:

the improvement comprising an annular radial disk (32) at a joint between the gun barrel section and tube section to retard heat flow from the barrel to the tube section, and a tubular liner (30) fitting within the firing chamber; said liner extending the full length of the firing chamber so that its forward end abuts the radial disk and its aft end abuts the breech block; said liner and disk being formed of a material having thermal insulation properties so as to offer substantial resistance to flow of heat from the firing chamber into the chamber wall and tube section; said liner being telescopically received in the firing chamber so that the outer surface of the liner has a slidable slip fit on the inner surface of the firing chamber wall, whereby the liner can be removed and replaced with another similar liner; said liner having at least two circumferentially spaced openings (31) in its side surface near its aft end for engagement with a pulling implement when it is desired to remove the liner from the chamber.

2. In a gun designed to fire a round of ammunition comprised of a projectile and attached combustible cartridge, said cartridge being completely combustible; said gun comprising an annular barrel section defining a firing chamber designed to receive the cartridge, a tube section defining a guide surface for the projectile as it travels out of the gun, and a transversely movable breech block designed to removably close the aft end of the firing chamber when a cartridge is disposed therein:

the improvement comprising a tubular liner snugly received in the firing chamber in pressure-transmitting relation to the firing chamber wall; said liner being formed of a material having thermal insulation properties whereby the liner offers substantial resistance to flow of heat from the firing chamber into the firing chamber wall;

said liner extending the full axial length of the firing chamber between the gun tube section and the breech block; said liner being telescopically received in the firing chamber so that the outer surface of the liner has a slidable slip fit on the inner surface of the firing chamber wall, whereby the liner can be removed and replaced with another similar liner; said liner having at least two circumferentially spaced openings (31) in its side surface near its after end for engagement with a pulling implement when it is desired to remove the liner from the firing chamber; said breech block having an open position wherein the liner can be removed from the firing chamber without disconnecting the breech block from its normal operating condition on the gun.

* * * * *